US008466842B2

(12) United States Patent
Dai

(10) Patent No.: US 8,466,842 B2
(45) Date of Patent: Jun. 18, 2013

(54) WINDOW ANTENNA

(75) Inventor: David Dai, Novi, MI (US)

(73) Assignee: Pittsburgh Glass Works, LLC, Pittsburgh, PA (US)

( * ) Notice: Subject to any disclaimer, the term of this patent is extended or adjusted under 35 U.S.C. 154(b) by 420 days.

(21) Appl. No.: 12/910,343

(22) Filed: Oct. 22, 2010

(65) Prior Publication Data

US 2012/0098716 A1 Apr. 26, 2012

(51) Int. Cl.
*H01Q 1/32* (2006.01)

(52) U.S. Cl.
USPC ..... 343/713; 343/712

(58) Field of Classification Search
USPC ..... 343/711, 712, 713, 906, 767, 769
See application file for complete search history.

(56) References Cited

U.S. PATENT DOCUMENTS

| | | | | |
|---|---|---|---|---|
| 3,655,545 | A | | 4/1972 | Gillery et al. |
| 3,962,488 | A | | 6/1976 | Gillery |
| 4,091,386 | A | | 5/1978 | Luedtke et al. |
| 4,707,700 | A | | 11/1987 | Nagy |
| 4,721,963 | A | | 1/1988 | Nagy et al. |
| 4,768,037 | A | | 8/1988 | Inaba et al. |
| 4,849,766 | A | | 7/1989 | Inaba et al. |
| 4,864,316 | A | | 9/1989 | Kaoru et al. |
| 4,898,789 | A | | 2/1990 | Finely |
| 5,083,135 | A | | 1/1992 | Nagy et al. |
| 5,355,144 | A | | 10/1994 | Walton et al. |
| 5,528,314 | A | | 6/1996 | Nagy et al. |
| 5,646,637 | A | | 7/1997 | Miller |
| 5,670,966 | A | | 9/1997 | Dishart et al. |
| 5,739,794 | A | * | 4/1998 | Nagy et al. ..... 343/713 |
| 5,831,580 | A | | 11/1998 | Taniguchi et al. |
| 5,898,407 | A | | 4/1999 | Paulus et al. |
| 6,020,855 | A | * | 2/2000 | Nagy et al. ..... 343/713 |
| 6,097,345 | A | | 8/2000 | Walton et al. |
| 6,201,504 | B1 | | 3/2001 | Aminzadeh et al. |
| 6,271,798 | B1 | | 8/2001 | Endo et al. |
| 6,307,519 | B1 | | 10/2001 | Livingston et al. |
| 6,317,090 | B1 | | 11/2001 | Nagy et al. |
| 6,448,935 | B2 | | 9/2002 | Fuchs et al. |
| 6,498,588 | B1 | | 12/2002 | Callaghan |

(Continued)

FOREIGN PATENT DOCUMENTS

| | | |
|---|---|---|
| EP | 375415 | 6/1990 |
| EP | 561272 | 9/1993 |
| JP | 09175166 | 7/1997 |
| JP | 2002290145 | 10/2002 |

OTHER PUBLICATIONS

Walton E.K., "Automotive Conformal Antenna Research at the Ohio State University", IEEE Antennas and Propogation Society International Symposium (2001).

(Continued)

*Primary Examiner* — Hoanganh Le
(74) *Attorney, Agent, or Firm* — Cohen & Grigsby, P.C.

(57) ABSTRACT

A vehicle window assembly. The window assembly includes a glass ply and an electro-conductive coating located on a surface of the glass ply. The electro-conductive coating has an outer peripheral edge that is adapted to be spaced from an inner metal edge of a vehicle frame so as to define an antenna slot. The electro-conductive coating includes at least one deleted portion adjacent the outer peripheral edge, wherein the deleted portion is sized to tune the antenna slot to a desired resonant frequency.

26 Claims, 8 Drawing Sheets

U.S. PATENT DOCUMENTS

| | | | |
|---|---|---|---|
| 6,646,618 | B2 | 11/2003 | Sievenpiper |
| 6,806,839 | B2 | 10/2004 | Lo |
| 6,937,198 | B2 | 8/2005 | Iijima et al. |
| 7,071,886 | B2 | 7/2006 | Doi et al. |
| 7,190,316 | B2 | 3/2007 | Yegin et al. |
| 2005/0195115 | A1 | 9/2005 | Yegin et al. |

OTHER PUBLICATIONS

Oshima et al., "Use of a Transparent Conductive Thin-film on a Glass Substrate in Active Integrated Antenna Arrays with Double Strong Coupling", IEEE MTT-S Digest, 1569-1572 (2002).
Nagy, Louis L., "New Generation of Antennas for Automobile Use", SAE Special Publications, (1987).

* cited by examiner

WINDOW ANTENNA

BACKGROUND

Automotive vehicle window antennas, including embedded wire or silver print antennas in rear windows and windshields, have been used for many years. More recently, metal coated infrared ray reflective thin films have been used as antennas.

Several antennas have been proposed which use a wire antenna of a quarter or half wavelength that is formed in a vehicle window by a thin film or a conductive coating on or between the layers of the glass window. Such designs may include automotive antennas that have several electrically interconnected coating regions and a transparent coating in the shape of a "T". Also, antennas that divide the conductive coating into two pieces and have the AM and FM antennas separated to reduce AM noise and improve system performance are known.

Another proposed solution is to form a slot antenna between the metal frame of a window and a conductive transparent film panel that is bonded to the window and has an outer peripheral edge spaced from the inner edge of the window frame to define the slot antenna. Examples utilize at least one edge with a conductive coating overlapping the window frame of the vehicle body to short the coating to ground at high frequencies by coupling so as to improve transmission and reception of radio frequency waves.

From an aesthetic point of view the slot antenna concept is a generally good solution because the antenna is invisible and can be used on any window. Another benefit is a heat load reduction because the slot antenna removes a small area of heated reflective coating compared to other antenna concepts. There are various technical challenges to implementing slot antennas, especially on the windshield of a vehicle. First, there is only a limited area around the window perimeter to put the antenna elements and it may be difficult to design an antenna to meet the performance requirements. Second, slot antennas are difficult to tune to a frequency band because the antenna characteristics depend on the slot dimensions. For example, the perimeter of the window defines the maximum slot length, which defines the lowest frequency application. The lowest frequency applications may not be in the frequency band of interest. Various windshield and back glass window slot antennas can cover the FM frequency band but not the TV band I (47 MHz-68 MHz). Thus, there is a need for an antenna, for example a windshield hidden antenna, with a tunable frequency band for different applications. There is also a need for a vehicle slot antenna with advanced antenna matching and frequency tuning methods that can be used to design an antenna with acceptable performance while retaining all solar benefits of the heat reflective coating and having good aesthetics.

SUMMARY

Various embodiments of the present invention are directed to a vehicle window assembly. The vehicle window assembly includes a frame having an inner metal edge and a window pane fixed to the frame. The window pane includes an inner glass ply, an outer glass ply, and an interlayer between the inner glass ply and the outer glass ply. The window pane also includes an electro-conductive coating located on a surface of the outer glass ply, wherein the electro-conductive coating has an outer peripheral edge spaced from the inner metal edge of the frame to define an antenna slot, and wherein the electro-conductive coating includes at least one deleted portion adjacent the antenna slot, wherein the deleted portion is sized to tune the antenna slot to a desired resonant frequency. The vehicle window assembly further includes an antenna feed structure electrically connected to the outer peripheral edge of the electro-conductive coating.

Various embodiments of the present invention are directed to a vehicle window assembly. The window assembly includes a glass ply and an electro-conductive coating located on a surface of the glass ply. The electro-conductive coating has an outer peripheral edge that is adapted to be spaced from an inner metal edge of a vehicle frame so as to define an antenna slot. The electro-conductive coating includes at least one deleted portion adjacent the outer peripheral edge, wherein the deleted portion is sized to tune the antenna slot to a desired resonant frequency.

Those and other details, objects, and advantages of the present invention will become better understood or apparent from the following description and drawings showing embodiments thereof.

BRIEF DESCRIPTION OF THE DRAWINGS

Various embodiments of the present invention are described herein by way of example in conjunction with the following figures, wherein.

DESCRIPTION

Embodiments of the present invention are directed to a slot antenna for a vehicle. The slot antenna forms between the metal frame of a window and a conductive transparent film panel that is bonded to the window and has an outer peripheral edge spaced from the inner edge of the window frame to define a slot antenna. The slot length is chosen such as to support fundamental modes, at frequency bands of interest. The annular slot formed between the vehicle frame and the conductive coating edges is the longest slot size and thus defines the fundamental mode with the lowest resonant frequency. The total slot length may be one wavelength for annual slot antenna or one-half wavelength for non annular shaped slot for the fundamental excitation mode.

The slot length can be electrically shorted by overlapping one or more edges of the window coating with the vehicle frame such that the radio frequency signal is shorted to the vehicle frame through coupling. This provides a manner of tuning the slot antenna for different applications of higher frequency bands. Slot antennas formed from different sides of a window have different field distributions and different antenna patterns and hence yield a diversity of reception.

The slot length can be increased by introducing one or more slits on its perimeter by removing the conductive coating. The radio frequency current is forced to detour around the slits and therefore increases the electrical length of the slot. As a result the resonant mode frequency is shifted towards lower frequency bands. The length, width, and number of slits are determined by the window size and the frequency band of interest.

In various embodiments, the slot antenna can either be fed directly or by capacitive coupling. The coupling feed may have the advantage of easier antenna tuning and manufacture. The antenna feeding structure in various embodiments is designed to excite multiple modes of the slot antenna to support applications of different electronic devices at different frequency bands.

Figure 1:
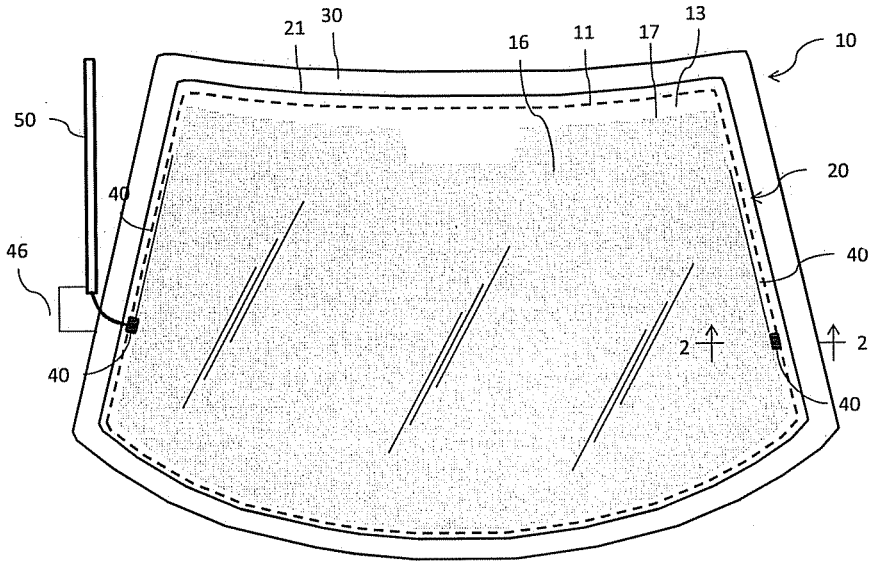
FIG. 1 illustrates a transparent glass antenna according to various embodiments of the present invention.
Figure 2:
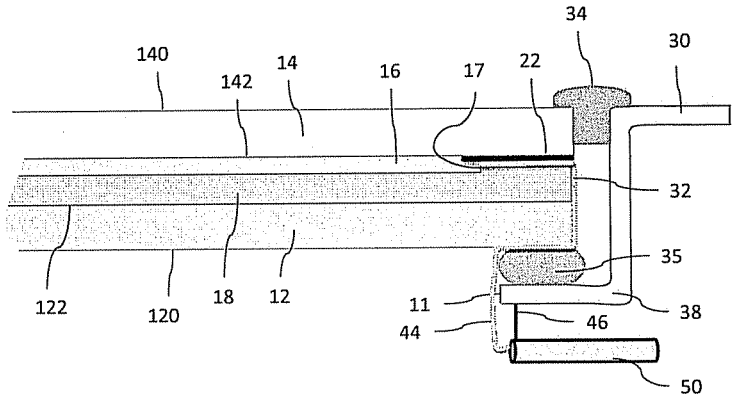
FIGS. 2-4 are sectional views taken along line 2-2 in FIG. 1 in accordance with various embodiments of the present invention.

FIG. 1 illustrates a transparent windshield assembly 10 and its associated body structures according to various embodiments of the present invention. A windshield 20 is surrounded by a metal frame 30, which has a window aperture defined by a vehicle body window edge 11. As described herein, embodiments of the present invention may be used on windows and window assemblies that are not windshields but other types of windows or window assemblies. For example, embodiments of the present invention may be incorporated into any window or sunroof. In the interest of clarity, all such windows and window assemblies are referred to herein as windshield 20. An outer edge 21 of the windshield 20 overlaps an annular flange 38 of the frame 30 to allow securing of the windshield 20 to the vehicle body of which the frame 30 is a part. As seen in FIG. 2, an annular sealing member 35 is placed between the windshield 20 and the flange 38 and a molding 34 bridges the outer gap between the frame 30 and the windshield 20.

The windshield 20 may be a standard laminated vehicle windshield formed of outer glass ply 12 and inner glass ply 14 bonded together by an interposed layer, or interlayer, 18. The interposed layer 18 may be constructed of, for example, a standard polyvinylbutyral or any type of plastic material. The outer glass ply 14 has an outer surface 140 (conventionally referred to as the number 1 surface) on the outside of the vehicle and an inner surface 142 (conventionally referred to as the number 2 surface). The inner glass ply 12 has an outer surface 122 (conventionally referred to as the number 3 surface) on the inside of the vehicle and an inner surface 120 (conventionally referred to as the number 4 surface) internal to the windshield 20. The interlayer 18 is between the surfaces 142 and 122.

As shown in FIG. 2, the windshield 20 may include a dark, or black, paint band 22 around the perimeter of the windshield 20 to conceal the antenna elements and other apparatus (not shown) around the edge of the windshield 20.

The windshield 20 further includes an electro-conductive element, or conductive coating, 16 which occupies the daylight opening of the transparency. The coating 16 may be constructed of transparent electro-conductive coatings applied on the surface 142 of the outer glass ply 14 (as shown in FIG. 2) or on the surface 122 of the inner glass ply 12, in any manner known in the art. The coating 16 may include in single or multiple layers, a metal containing coating such as, for example, those disclosed in U.S. Pat. No. 3,655,545 to Gillery et al., U.S. Pat. No. 3,962,488 to Gillery and U.S. Pat. No. 4,898,789 to Finley.

The conductive coating 16 has a peripheral edge 17 which is spaced from the vehicle body window edge 11 and defines an annular antenna slot 13 between the edge 11 and the peripheral edge 17. In one embodiment, the slot width is sufficiently large enough that the capacitive effects across it at the frequency of operation are negligible such that the signal is not shorted out. In one embodiment, the slot width is greater than 10 mm. In one embodiment, the length of the slot 13 is an integer multiple of wavelength for an annular slot or an integer multiple of one-half of the wavelength for a non-annular slot with respect to resonant frequency of the desired application. For a windshield of a typical vehicle, the slot length is such as to resonant at the VHF band and can be used for TV VHF band and FM applications.

FIG. 2 illustrates one embodiment in which the slot antenna is directly fed by an unbalanced transmission line, such as a coaxial cable 50. A metal foil, such as a copper foil, 32 is conductively connected to the peripheral edge 17 and is laminated with the interlayer 18 between the outer glass ply 14 and the inner glass ply 12. The copper foil 32 is folded back around the edges of the interlayer 18 and the inner glass ply 12 and sandwiched between the surface 120 of the inner glass ply 12 and the sealing member (e.g., a glue bead) 35. The copper foil 32 is conductively connected to a center conductor 44 of the coaxial cable 50. The copper foil 32 may be covered by, for example, plastic tape so that it is isolated from contact with the frame 30 and shorts out the radio frequency signals when they pass through the flange 38 and the sealing member 35. The cable ground 46 is connected to the frame 30 near the inner metal edge 11 of the window flange 38.

It may be difficult to conductively connect the center conductor 44 of the coaxial cable 50 to the coating 16 because the coating 16 is thin. Also, the antenna matching and tuning may be difficult because the antenna elements may be laminated inside the glass plies 12 and 14 without easy access. The higher order modes of the slot 13 present a significant reactive component and, in one embodiment, only the two lower modes in the VHF band can be excited with mode impedance of approximately 50Ω using the antenna feeding method described herein.

Figure 3:
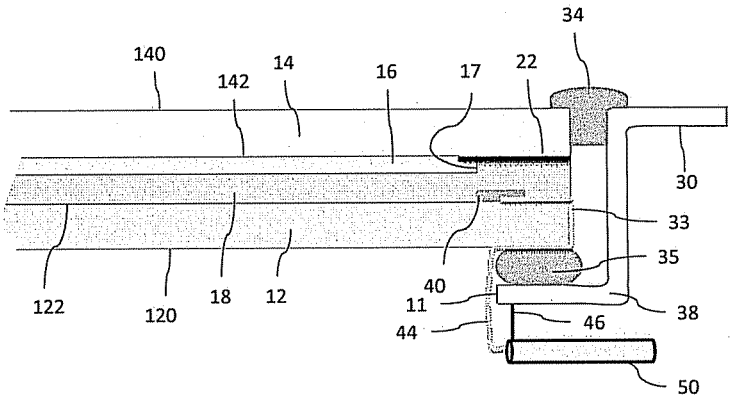

FIG. 3 illustrates an embodiment of an antenna feeding arrangement that can be used to capacitavely connect the center conductor 44 to the coating 16 using a printed ceramic line on surface 120 of the inner glass ply 12. The center conductor 44 is thus connected to a more robust ceramic print on the surface of the inner glass ply 12. A shown in FIG. 3, the antenna feeding element 40 is incorporated between the glass plies 12 and 14. The feeding element 40 may be, for example, a metal layer such as a copper tape, a silver ceramic, or any other metal tape that is bonded to the surface 122 of the inner glass ply 12 and is separated from the coating 16 by the interlayer 18. A metal foil, such as a copper foil, 33, soldered to the antenna feeding element 40 and covered with, for example, plastic tape, is connected conductively to the center conductor 44 of a coaxial cable 50 in, for example, a conventional manner, such as soldering or through a mating blade connector.

Figure 4:
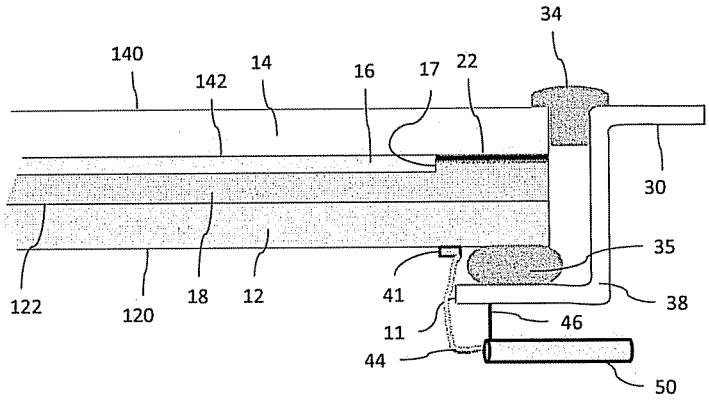

FIG. 4 illustrates an embodiment in which an antenna feeding element 41, such as a metal tape or a silver ceramic, is bonded to the interior surface 120 of the inner glass ply 12. The antenna feeding element 41 is separated from coating 16 by the interlayer 18 and the inner glass ply 12. The center conductor 44 of the coaxial cable 50 is connected to the antenna feeding element 41 by an insulated wire or foil in, for example, a conventional manner, such as soldering or through a mating blade connector.

The capacitive coupling may preferably, in various embodiments, be an antenna feeding arrangement because in various embodiments it provides a relatively easier manufacturing process and gives an opportunity for antenna tuning and impedance matching. The antenna feeding arrangement presents an impedance transfer into the slot antenna modes with its own impedances, which is a function of feed position, frequency and mode. Only the modes that are matched to the transmission line characteristic impedance, for example 50Ω, can be excited. Comparing to the direct feed as shown in FIG. 2, the capacitive coupling feed as shown in FIG. 4 may provide easier access for tuning the capacitance for impedance matching because the antenna feeding element 41 is on the interior surface 120 of the inner glass ply 12. The impedance of the slot antenna 13 in accordance with embodiments of the present invention has a real component and a reactive component. In various embodiments, the higher order modes of the slot antenna 13 were found to have a reactive component which is conductive. Only the real part represents radiation loss. Because the capacitance between the antenna feeding element 41 and the coating 16 is determined by the interfacing area, the distance between the elements, and the dielectric constant of the material, the interfacing area and the distance can be selected by design to match the antenna to the transmission line and thus minimize the net reactive component seen by the transmission line and thereby maximize radio frequency energy transfer, especially for the UHF frequency band. The antenna feed location can be selected such that certain modes can be excited for each application of different frequencies. The capacitive coupling also provides DC isolation from the coating 16 when the resistance of the coating 16 is used for, for example, defogger or deicing purposes.

Referring again to FIG. 1, in one embodiment two antennas may be symmetrically located along an A-pillar of the vehicle body in which the windshield 20 is mounted. In one embodiment the two antenna feeds are at least $\lambda/4$ wavelength apart and are weakly coupled and thus both can be used simultaneously for, for example, an FM and TV diversity antenna system. The antenna can be fed at the top and the bottom of the windshield 20 resulting in more spatial and pattern diversity. The antenna feed at the sides provides more antenna gain for horizontal polarization while the antenna feed at the top and bottom gives more gain in vertical polarization.

The resonant frequencies of the antenna fundamental modes are determined predominantly by the slot length, which can be designed such that the mode resonant frequencies are aligned with the operation frequencies of vehicle electronics systems. The slot length can be shorted by overlapping one or more side edges of the coating 16 with the vehicle frame 30 such that the radio frequency signal is shorted to the frame 30 through capacitive coupling. Such an arrangement allows for tuning the slot antenna 13 for different applications of higher frequency bands. The longest slot length is the total length of the windshield perimeter, i.e., the length of the slot 13 as shown in FIG. 1. The slot length can be further increased by introducing one or more slits near the edge portions of the coating 16 by removing a portion or portions of the coating 16. The radio frequency current is forced to detour around the slits and therefore increases the electrical length of the slot 13. As a result the resonant mode frequency is shifted towards a lower frequency band. Therefore, antennas incorporating features of embodiments of the present invention provide an arrangement that can tune the antenna resonant frequency higher or lower to meet the needs of the vehicle electronics system.

Figure 5:
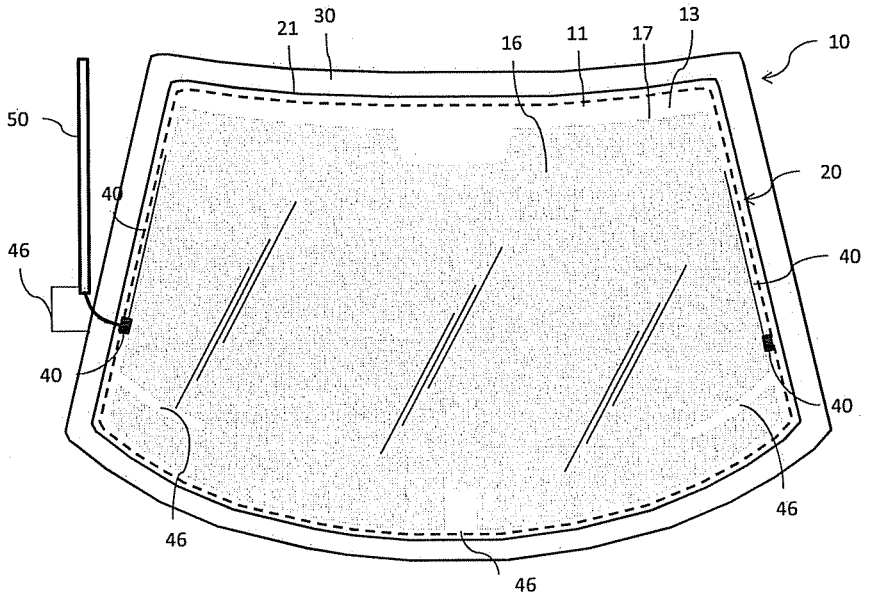
FIG. 5 illustrates a transparent glass antenna according to various embodiments of the present invention.

FIG. 5 illustrates a transparent glass antenna according to various embodiments of the present invention. The total slot length is increased by introducing three slits 46 on the perimeter of the coating 16. This is done by removing the coating 16 at targeted areas through, for example, mask or laser deletion. The electromagnetic current is forced to detour around the slits 46 and therefore the electrical length of the slot 13 is increased. As a result the resonant mode frequency is shifted towards a lower frequency band. The length, width, and number of slits are determined by the window size and the frequency band of interest. In one embodiment, the slits are introduced in any part of the conductive coating 16 in, for example, the dark paint band 22 such that the deletion is not visible.

Figure 6:
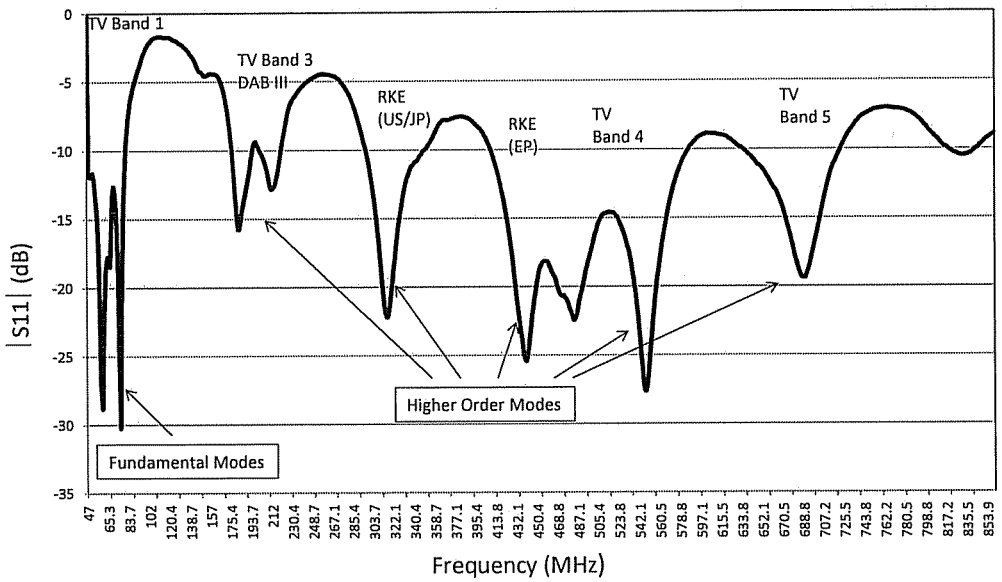
FIG. 6 is plot of antenna return loss in the antenna resonant frequency bands from 47 MHz to 860 MHz.

An embodiment similar to that illustrated in FIG. 5 was constructed and tested. FIG. 6 is a plot of the return loss (S11) of the slot antenna 13. Return loss S11 represents how much power is reflected from the antenna. If S11=0 dB, then all the power is reflected from the antenna and nothing is radiated. If S11=−10 dB, this implies that 10% of the power delivered to the antenna is reflected. The rest was "accepted" by the antenna and the majority of the power delivered to the antenna is radiated. FIG. 6 shows that the antenna radiates well in multiple bands from 45 MHz up to 860 MHZ, which covers TV band I (47-68 MHz), TV band III (174 MHz-230 MHz), DAB band III (174 MHz-240 MHz), Remote Keyless Entry (RKE) (315 MHz and 433.92 MHz), and TV bands IV and V (474 MHz-860 MHz). The slot antenna demonstrates the capability for multi-band application which can reduce the number of antennas, simplify antenna amplifier design, and reduce overall costs for the antenna system.

Figure 7:
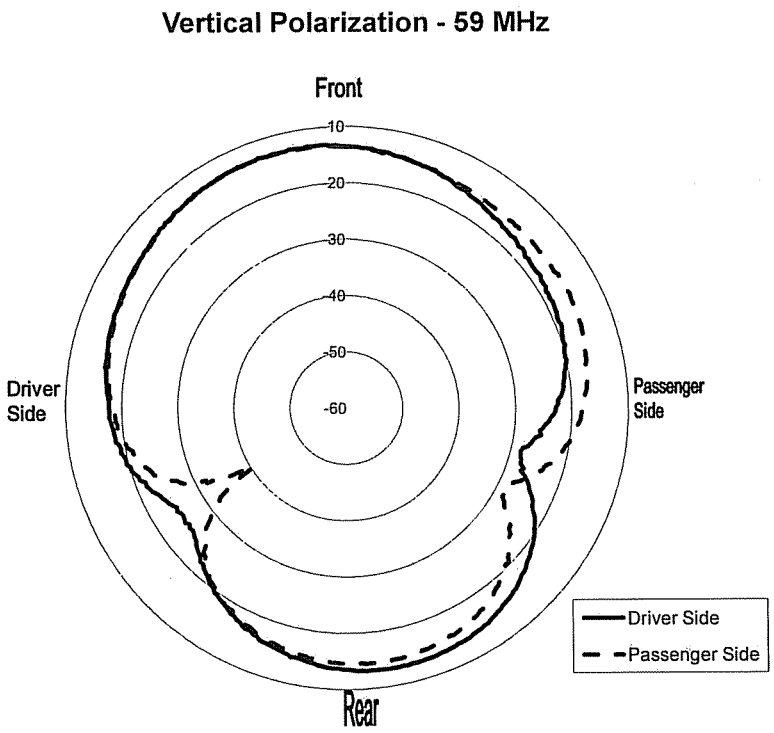
FIGS. 7-16 are polar plots illustrating the directional patterns of a vehicle antenna according to various embodiments of the present invention at different frequency bands for vertical and horizontal polarizations.
Figure 8:
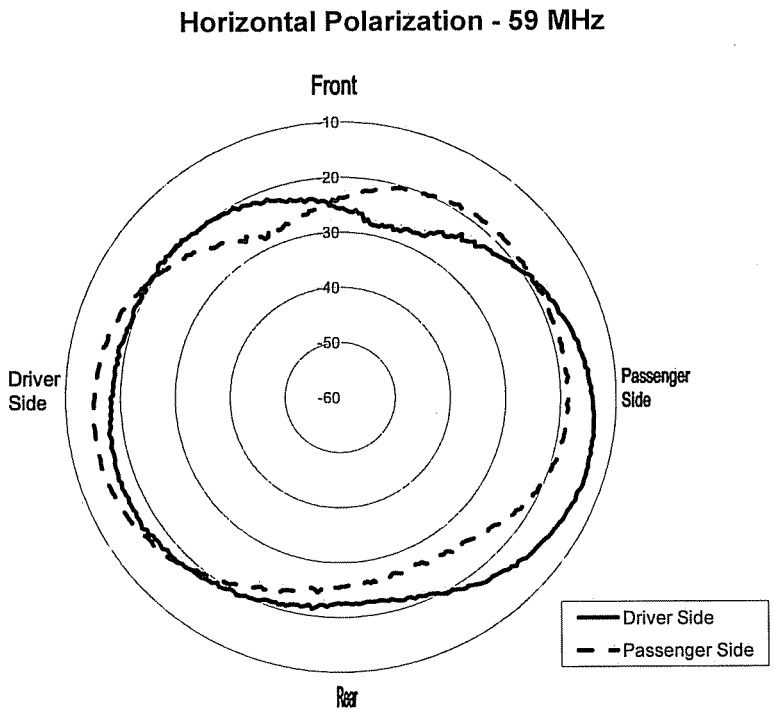
Figure 9:
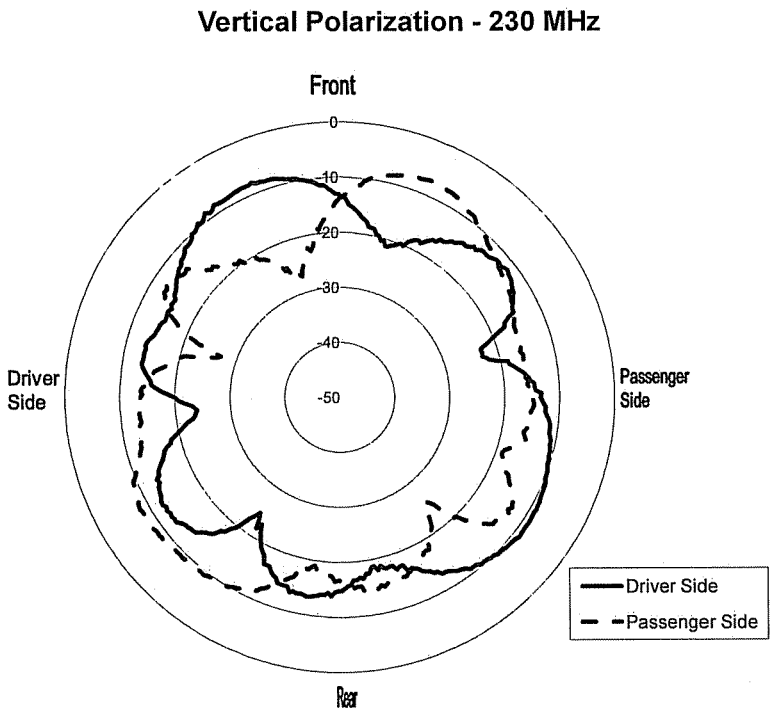
Figure 10:
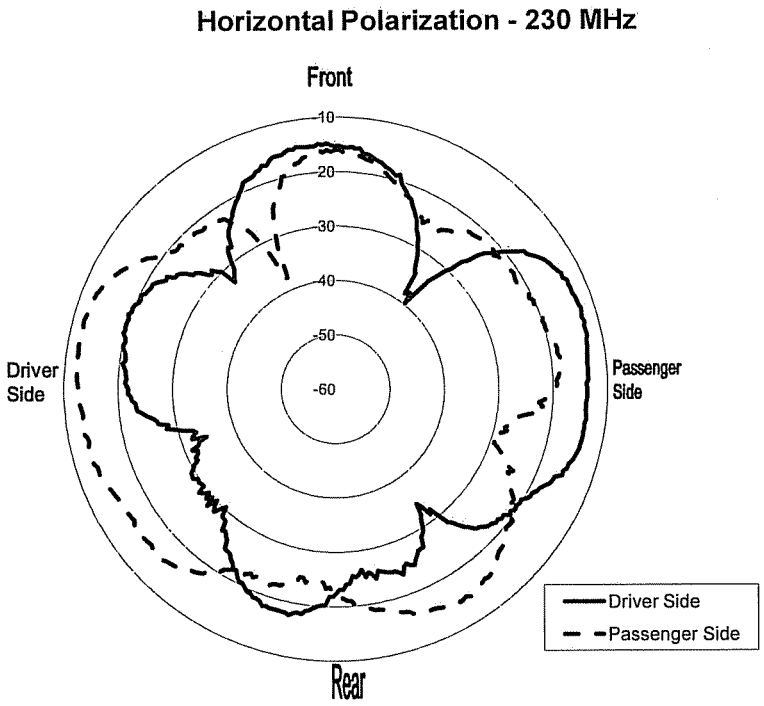
Figure 11:
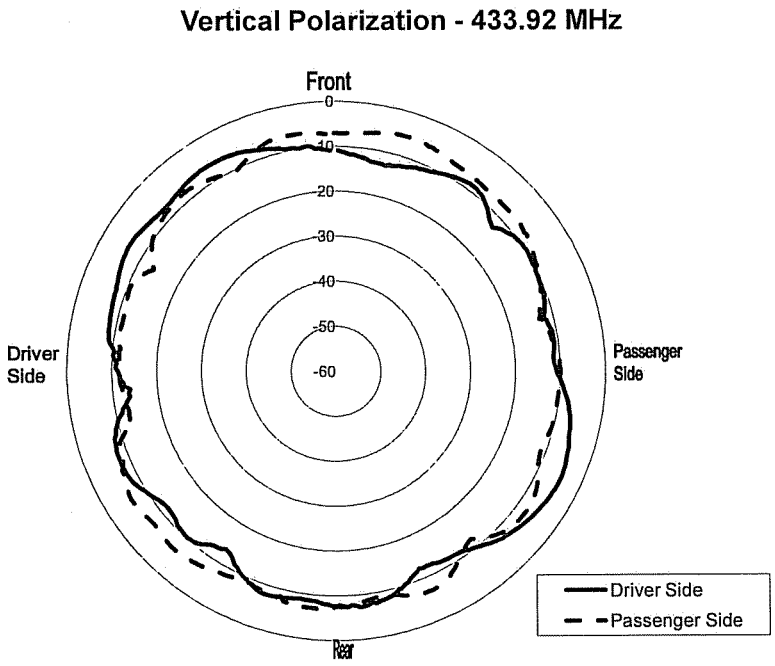
Figure 12:
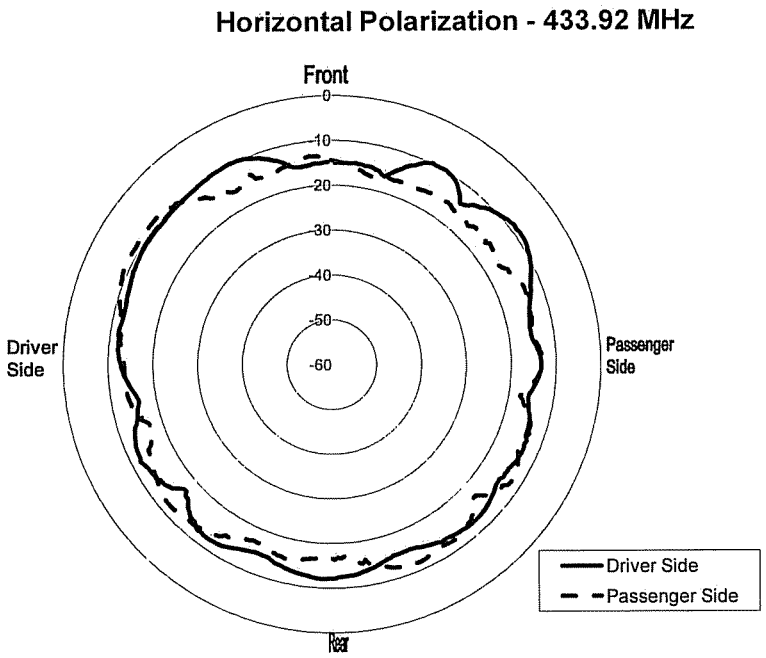
Figure 13:
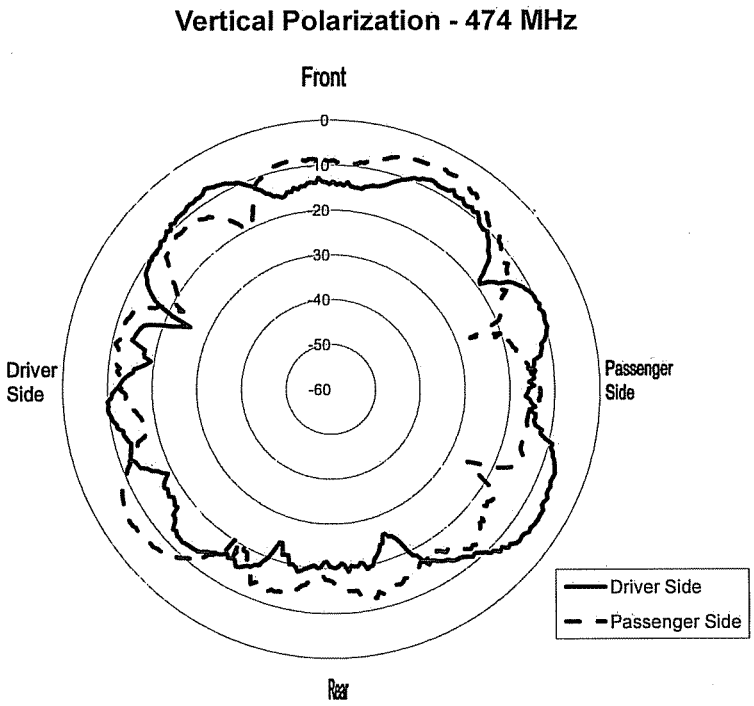
Figure 14:
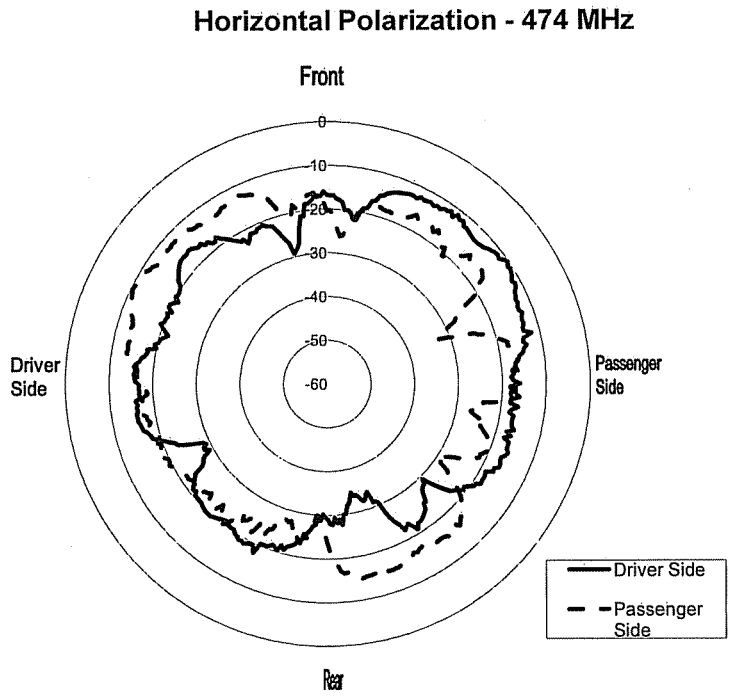
Figure 15:
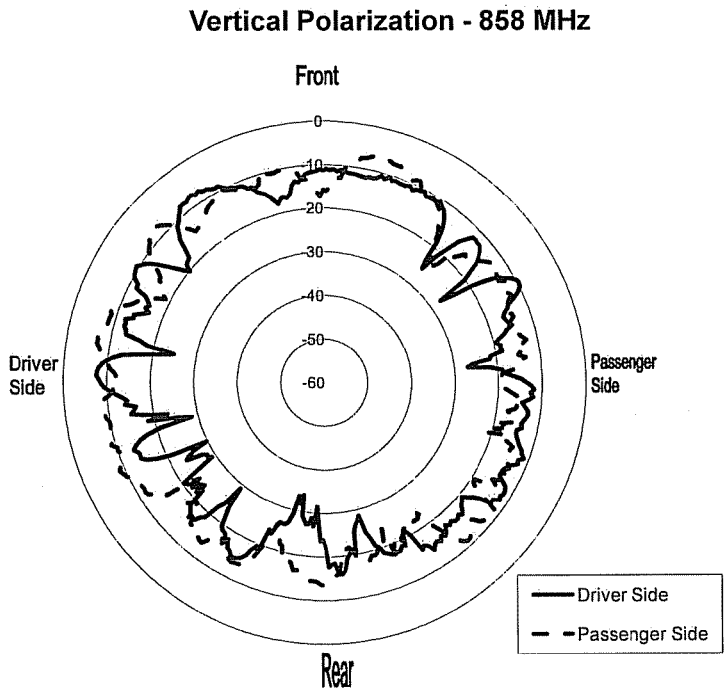
Figure 16:
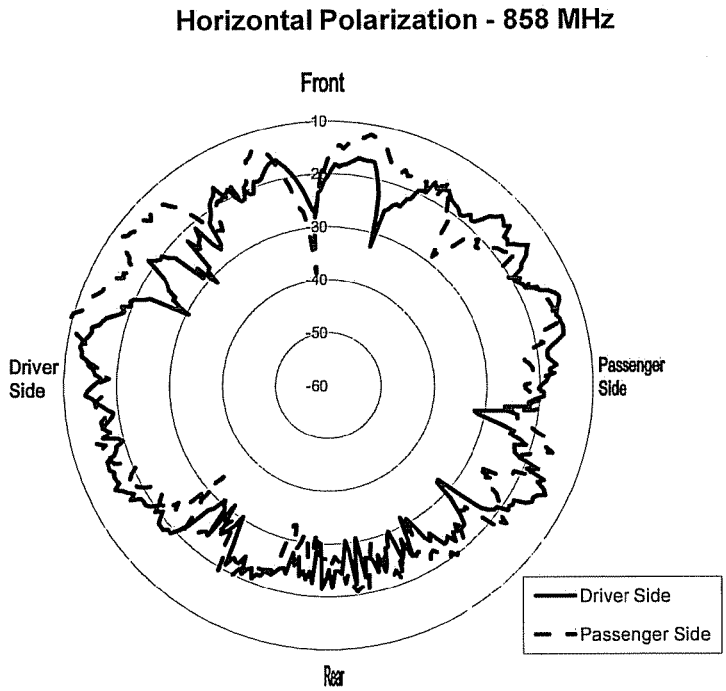

FIGS. 7-16 are polar plots showing the amplitude of the received signal as a' function of the direction of arrival of the signal with respect to the front of the vehicle at 4 frequency bands. In the plots, the radius is proportional to the signal power reference to dBi (relative to an isotropic antenna source), with each circle representing a 10 dB change. The circular axis represents the 360° divisions of direction with respect to the vehicle front. Each plot illustrates the antenna gain pattern at one frequency of each frequency band at vertical and horizontal polarizations. FIGS. 7 and 8 illustrate antenna gain patterns at 59 MHz in TV band I for vertical and horizontal polarizations, respectively. The patterns exhibit noticeable nulls in the two sides for vertical polarization and in the top and bottom for horizontal polarization. FIGS. 9 and 10 show antenna patterns of the same antenna for both polarizations at 230 MHz in TV band III. There are nulls in the pattern but not in the same directions for passenger side and driver side antennas, the combination of both antennas for diversity antenna systems provide a more uniform pattern over 360° of azimuth angles. FIGS. 11 and 12 illustrate the antenna pattern at the Remote Keyless Entry frequency of 433.92 MHz. For either vertical or horizontal polarizations, both antennas exhibit an azimuthally omnidirectional behavior with little signal variation as the orientation of the vehicle to a transmitter is changed. Antenna gain patterns of vertical and horizontal polarization at 474 MHz for TV band IV are illustrated in FIGS. 13 and 14. There are nulls in the patterns that do not occur in the same directions for passenger side and driver side antennas which provide more azimuthally uniform coverage for TV diversity antenna systems. FIGS. 15 and 16 show antenna patterns of the same antenna for both polarizations at 858 MHz in TV band V. There are noticeable nulls in the pattern but not present in the same locations for passenger side and driver side antennas, the combination of both antennas for diversity antenna system provide a more uniform pattern over 360° of azimuth angles.

Embodiments of the present invention are directed to a transparent slot antenna for, by way of example, a vehicle such as an automobile. The slot antenna includes an electroconductive coating on the surface of an outer glass ply applied to an area of the window. The conductive coating peripheral edge is spaced from the window edge to define an annular slot antenna. The resonant frequencies of the first two modes are adjustable by introducing a number of slits around the peripheral edges of the conductive coating by removing the coating in, for example, a dark, or black, paint band. A capacitive coupling feed structure is used to excite at least, for example, six modes of the slot antenna to cover the frequency range from, for example, 45 MHz to 860 MHz, which includes the TV VHF/UHF, the Remote Keyless Entry (RKE), and the DAB III frequency bands.

While several embodiments of the invention have been described, it should be apparent that various modifications, alterations and adaptations to those embodiments may occur to persons skilled in the art with the attainment of some or all of the advantages of the present invention. It is therefore intended to cover all such modifications, alterations and adaptations without departing from the scope and spirit of the present invention.

What is claimed is:

1. A vehicle window assembly, comprising:

a frame having an inner metal edge;

a window pane fixed to the frame, the window pane comprising:

an inner glass ply;

an outer glass ply;

an interlayer between the inner glass ply and the outer glass ply; and an electro-conductive coating located on a surface of the outer glass ply, wherein the electro-conductive coating has an outer peripheral edge spaced from the inner metal edge of the frame to define an antenna slot, and wherein the electro-conductive coating includes at least one deleted portion adjacent the antenna slot, wherein the deleted portion is sized to tune the antenna slot to a desired resonant frequency; and an antenna feed structure electrically connected to the outer peripheral edge of the electro-conductive coating.

2. The vehicle window assembly as claimed in claim 1, wherein the antenna feed structure is located in a dark paint band that is located on a peripheral area of the window pane.

3. The vehicle window assembly as claimed in claim 1, wherein a width of the antenna slot is sized such that a capacitive effect across the antenna slot at least one operation frequency is substantially negligible.

4. The vehicle window assembly as claimed in claim 3, wherein the width of the antenna slot is greater than 10 mm.

5. The vehicle window assembly as claimed in claim 1, wherein a total length of the antenna slot is one wavelength for an annular slot antenna and one-half wavelength for a non-annular slot antenna, of a fundamental excitation mode.

6. The vehicle window assembly as claimed in claim 1, wherein the antenna feed structure is capacitively coupled to the slot antenna.

7. The vehicle window assembly as claimed in 1, further comprising a capacitive coupling metal element located on a surface of the inner glass ply and extending substantially parallel with the outer peripheral edge of the electro-conductive coating, wherein the capacitive coupling metal element is for coupling a radio frequency signal into and out of the slot antenna.

8. The vehicle window assembly as claimed in 1, wherein the antenna feed structure is coupled to the slot antenna so as to excite both fundamental mode and higher-order modes in the VHF and UHF bands.

9. The vehicle window assembly as claimed in claim 1, wherein the deleted portion is deleted using one of mask deletion and laser deletion.

10. The vehicle window assembly as claimed in claim 1, wherein the antenna feeding structure is configured to match the slot antenna to a transmission line so as to minimize a net reactive component as seen by the transmission line and maximize RF energy transfer.

11. The vehicle window assembly as claimed in claim 1, wherein the slot antenna is configured to cover a frequency band from 45 MHz to 860 MHz.

12. The vehicle window assembly as claimed in claim 1, wherein at least a portion of the outer peripheral edge of the electro-conductive coating is in contact with the frame.

13. The vehicle window assembly as claimed in claim 1, wherein the interlayer comprises plastic.

14. The vehicle window assembly as claimed in claim 1, wherein the electro-conductive coating is substantially transparent.

15. A vehicle window assembly, comprising:

a glass ply; and an electro-conductive coating located on a surface of the glass ply, wherein the electro-conductive coating having an outer peripheral edge that is adapted to be spaced from an inner metal edge of a vehicle frame so as to define an antenna slot, and wherein the electro-conductive coating includes at least one deleted portion adjacent the outer peripheral edge, wherein the deleted portion is sized to tune the antenna slot to a desired resonant frequency.

16. The vehicle window assembly as claimed in claim 15, further comprising a second glass ply and an interlayer located between the glass ply and the second glass ply.

17. The vehicle window assembly as claimed in claim 15, further comprising a dark paint band located on an edge of the glass ply.

18. The vehicle window assembly as claimed in claim 15, wherein a width of the antenna slot is sized such that a capacitive effect across the antenna slot for at least one operation frequency is substantially negligible.

19. The vehicle window assembly as claimed in claim 15, wherein the width of the antenna slot is greater than 10 mm.

20. The vehicle window assembly as claimed in claim 15, wherein a total length of the antenna slot is one wavelength for an annular slot antenna and one-half wavelength for a non-annular slot antenna, of a fundamental excitation mode.

21. The vehicle window assembly as claimed in claim 15, further comprising a capacitive coupling metal element located on a surface of the glass ply and extending substantially parallel with the outer peripheral edge of the electro-conductive coating, wherein the capacitive coupling metal element is for coupling a radio frequency signal into and out of the slot antenna.

22. The vehicle window assembly as claimed in claim 15, wherein the deleted portion is deleted using one of mask deletion and laser deletion.

23. The vehicle window assembly as claimed in claim 15, wherein the slot antenna is configured to cover a frequency band from 45 MHz to 860 MHz.

24. The vehicle window assembly as claimed in claim 15, wherein at least a portion of the outer peripheral edge of the electro-conductive coating is configured to be in contact with the vehicle frame after installation of the vehicle window assembly into the vehicle frame.

25. The vehicle window assembly as claimed in claim 16, wherein the interlayer comprises plastic.

26. The vehicle window assembly as claimed in claim 15, wherein the electro-conductive coating is substantially transparent.

* * * * *